US007264577B2

(12) United States Patent
Lin

(10) Patent No.: US 7,264,577 B2
(45) Date of Patent: Sep. 4, 2007

(54) LOAD APPLYING DEVICE FOR EXERCISER

(76) Inventor: Hsien Mo Lin, No. 606, Donguanyuan Road, Donchu, Taichung 40152 (TW)

( * ) Notice: Subject to any disclaimer, the term of this patent is extended or adjusted under 35 U.S.C. 154(b) by 252 days.

(21) Appl. No.: 11/147,122

(22) Filed: Jun. 7, 2005

(65) Prior Publication Data

US 2006/0276307 A1 Dec. 7, 2006

(51) Int. Cl.
*A63B 22/06* (2006.01)

(52) U.S. Cl. ..... 482/63; 482/903

(58) Field of Classification Search ..... 482/51, 482/52, 56, 57, 60–63, 903, 908; 73/379.07; 188/24.11, 24.14, 26
See application file for complete search history.

(56) References Cited

U.S. PATENT DOCUMENTS

| | | | | |
|---|---|---|---|---|
| 4,775,145 | A | 10/1988 | Tsuyama | 272/73 |
| 4,898,379 | A | 2/1990 | Shiba | 272/73 |
| 5,031,901 | A * | 7/1991 | Saarinen | 482/63 |
| 5,310,392 | A * | 5/1994 | Lo | 482/63 |
| 5,848,953 | A * | 12/1998 | Wei et al. | 482/63 |
| 5,851,165 | A * | 12/1998 | Wei et al. | 482/63 |
| 6,468,186 | B2 * | 10/2002 | Lay | 482/63 |
| 6,485,397 | B1 * | 11/2002 | Manderbacka | 482/63 |
| 6,569,063 | B2 * | 5/2003 | Chen | 482/63 |
| 6,626,804 | B2 * | 9/2003 | Wang et al. | 482/63 |
| 6,821,236 | B2 | 11/2004 | Liang | 482/138 |
| 2003/0158016 | A1 * | 8/2003 | Kolda et al. | 482/61 |
| 2005/0233866 | A1 * | 10/2005 | Miyamaru et al. | 482/57 |

* cited by examiner

*Primary Examiner*—Cary E. O'Connor
*Assistant Examiner*—Tam Nguyen
(74) *Attorney, Agent, or Firm*—Charles E. Baxley

(57) ABSTRACT

A load applying device includes a rotary member rotatably supported on a base with a spindle, and a magnetic device adjustable concentrically relative to the rotary member, to adjust and to apply a retarding force against the rotary member. A lever may support the magnetic device, and has a curvature corresponding to that of the rotary member. The base includes a casing having two grooves for slidably receiving fasteners which may be threaded to the lever, for guiding the lever to move relative to the casing and the rotary member. Two blocks are engaged with the lever, and a moving device may move the blocks toward and away from each other, to adjust the lever relative to the rotary member.

6 Claims, 5 Drawing Sheets

LOAD APPLYING DEVICE FOR EXERCISER

BACKGROUND OF THE INVENTION

1. Field of the Invention

The present invention relates to a load applying device, and more particularly to a magnetic load applying device having a magnetic retarding device adjustable relative to a wheel concentrically.

2. Description of the Prior Art

Various kinds of typical load applying devices have been developed and attached to an exerciser, and comprise a wheel or a disc rotatably supported on a base, and rotated or driven by various kinds of driving mechanisms, such as pedaling mechanisms, and a magnetic retarding device disposed on an outer peripheral portion of the wheel or disc, in order to apply a resistive retarding force against the wheel or disc of the exerciser.

For example, U.S. Pat. No. 4,775,145 to Tsuyama discloses one of the typical magnetic load applying devices for an exercise device and also comprising a magnetic retarding device disposed on an outer peripheral portion of a wheel or disc, in order to apply a resistive retarding force against the wheel or disc, and thus to resist the rotational movement of the wheel or disc. However, the magnetic retarding device is stationarily disposed beside the wheel or disc, and may not be adjusted toward or away from the wheel or disc.

U.S. Pat. No. 4,898,379 to Shiba discloses another typical load applying device for an exercise device and comprising a roller for applying a load to a tire of a rear wheel. The roller is required to be forced against the tire, in order to brake the tire. However, the tire may be forced to move against or to act onto the spindle of the tire, such that a frictional force may be generated or occurred between the tire and the spindle thereof, and such that the spindle may be easily worn out.

U.S. Pat. No. 6,821,236 to Liang discloses a further typical magnetic load applying devices for an exercise device and also comprising a magnetic retarding device including one end pivotally attached to a supporting base, and the other end movable toward and away from the outer peripheral portion of a wheel or disc, in order to apply a resistive retarding force against the wheel or disc, and thus to resist the rotational movement of the wheel or disc. However, the magnetic retarding device is arranged eccentric relative to the wheel or disc, and may also apply an eccentric force against the wheel, such that the frictional force may also be generated or occurred between the wheel and the spindle thereof, and such that the spindle may also be easily worn out.

The present invention has arisen to mitigate and/or obviate the afore-described disadvantages of the conventional load applying devices.

SUMMARY OF THE INVENTION

The primary objective of the present invention is to provide a load applying device including a magnetic retarding device adjustable relative to a wheel concentrically, to allow the magnetic retarding device to be moved either toward or away from the wheel concentrically.

In accordance with one aspect of the invention, there is provided a load applying device comprising a base, a rotary member rotatably supported on the base with a spindle, a magnetic device, and an adjusting device for adjusting the magnetic device concentrically relative to the rotary member, to adjust and to apply a retarding force against the rotary member.

The adjusting device includes a lever to support the magnetic device, and having a curvature corresponding to that of the rotary member. The base includes a casing disposed thereon and having two grooves formed therein, each for slidably receiving a fastener therein, the fasteners are threaded to the lever, for guiding the lever to move along the grooves of the casing, and for adjusting the lever and the magnetic device concentrically relative to the rotary member.

The adjusting device includes two blocks to engage with the lever, and a moving device for moving the blocks toward and away from each other, and thus to adjust the lever relative to the rotary member. The blocks each includes a screw hole formed therein, and the moving device further includes a fastener threaded with the screw holes of the blocks, and arranged to move the blocks toward and away from each other, when the fastener is rotated relative to the blocks.

The fastener includes a head attached thereto, for engaging with a driving tool. The screw holes of the blocks are arranged opposite to each other, and the fastener includes two outer threads formed thereon, for threading with the screw holes of the blocks respectively. The blocks each includes a recess formed therein for slidably receiving the lever.

The base includes a casing disposed thereon and having two slots formed therein, each for slidably receiving a fastener therein, the fasteners are threaded to the blocks respectively, for guiding the blocks to move along the slots of the casing respectively, and for adjusting the blocks to move toward and away from each other, in order to adjust the lever and thus the magnetic device relative to the rotary member.

The magnetic device includes a core extended from the lever, and a coil engaged around the core, for generating a magnetic force to act onto the rotary member. The base includes a driving device disposed thereon and coupled to the rotary member, for driving the rotary member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
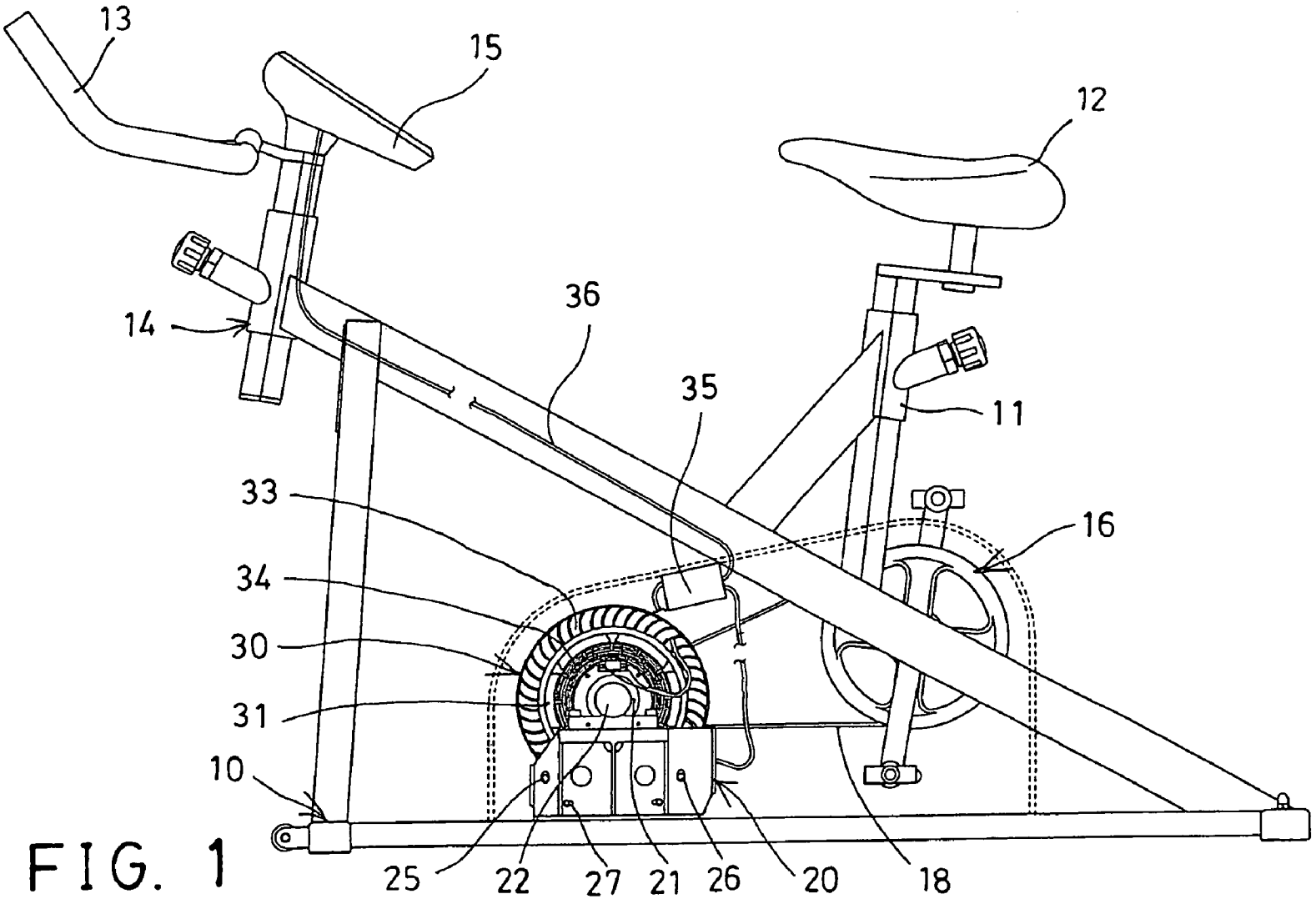
FIG. 1 is a side plan view of an exerciser having a load applying device in accordance with the present invention.
Figure 2:
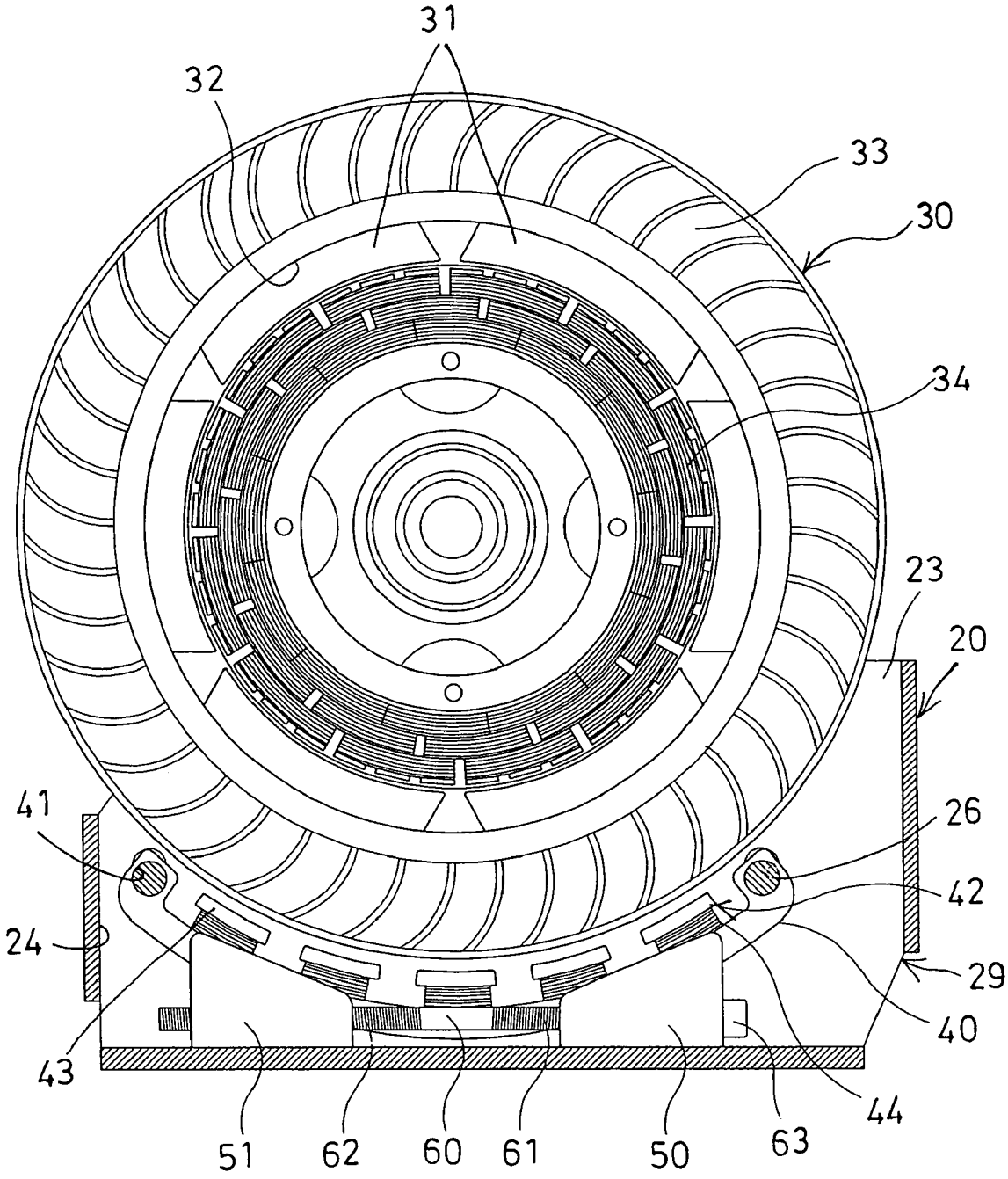
FIG. 2 is an enlarged partial cross sectional view of the load applying device.

Referring to the drawings, and initially to FIGS. 1 and 2, an exerciser in accordance with the present invention comprises a base 10 including a seat post 11 extended upwardly therefrom, for supporting a seat cushion 12 thereon, and including a handle 13 extended or provided on the front portion 14 thereof, for supporting the upper portion of the user, and including a typical control device 15 disposed on the front portion 14 thereof, for controlling the exerciser, for example.

The base 10 includes a casing 20 disposed thereon and having one or more, such as two brackets 21 extended upwardly therefrom, for rotatably attaching or supporting a wheel or a rotary member 30 thereon with a spindle 22. The casing 20 includes a channel 23 formed therein (FIGS. 3-5), and communicating with an inner chamber 24 thereof, for rotatably receiving the rotary member 30 therein.

The exerciser further includes a driving means or device 16, such as a foot pedaling and driving device 16 disposed on the base 10, and coupled to the rotary member 30 with a coupling device 18, such as a chain-and-sprocket coupling device 18, a belt-and-pulley coupling device 18, or other coupling devices 18, and arranged for allowing the rotary member 30 to be rotated or driven by the users with the driving device 16.

The rotary member 30 includes one or more magnets or magnetic members 31 disposed or attached to an inner peripheral portion 32 thereof, and rotated in concert with the rotary member 30, and includes a fan device 33 disposed or attached to the outer peripheral portion thereof, for generating air streams or air circulations, and/or for dissipating the heat that may be generated by the exerciser.

For example, the exerciser may further include a magnetic coil device 34 stationarily disposed on the base 10, such as attached to the brackets 21 of the casing 20 of the base 10, and disposed or arranged within the rotary member 30, for acting with the magnetic members 31 of the rotary member 30, and for generating electric energy when the rotary member 30 is rotated relative to the magnetic coil device 34 and the casing 20 of the base 10.

The magnetic coil device 34 may be coupled to a rectifying and/or controlling device 35, and may then be coupled with such as electric wires or cables 36, to the control device 15 and/or the batteries (not shown), and/or the other electric devices which will be discussed hereinafter, in order to energize the control device 15 and the other electric devices.

Figure 4:
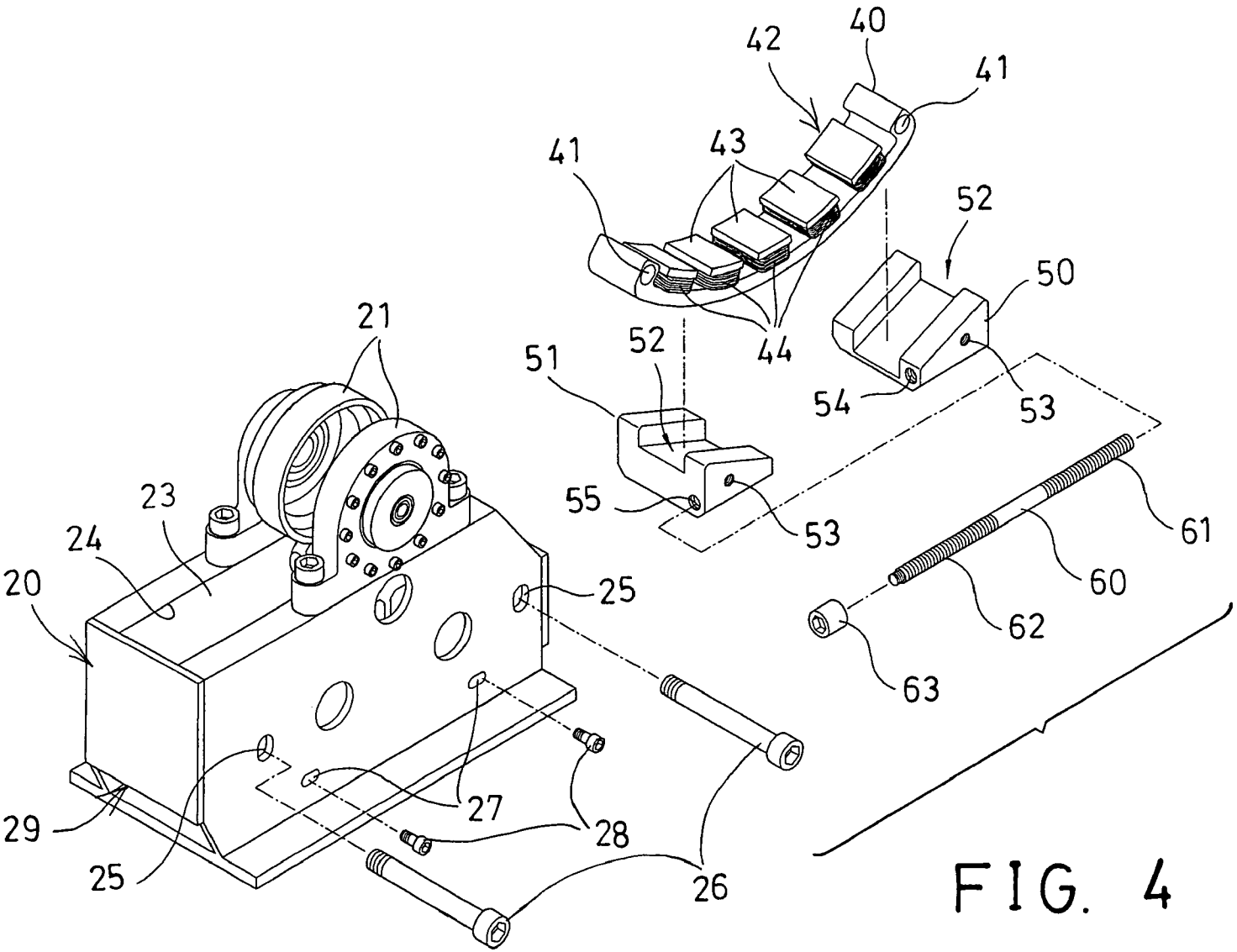
FIG. 4 is a partial exploded view of the load applying device.

As shown in FIGS. 1 and 4, the casing 20 includes two vertically extending grooves 25 formed therein, and communicating with the inner chamber 24 thereof, each for slidably receiving a fastener 26 therein, and includes two laterally or horizontally extending slots 27 formed therein, and also communicating with the inner chamber 24 thereof, each for slidably receiving another fastener 28 therein.

Figure 3:
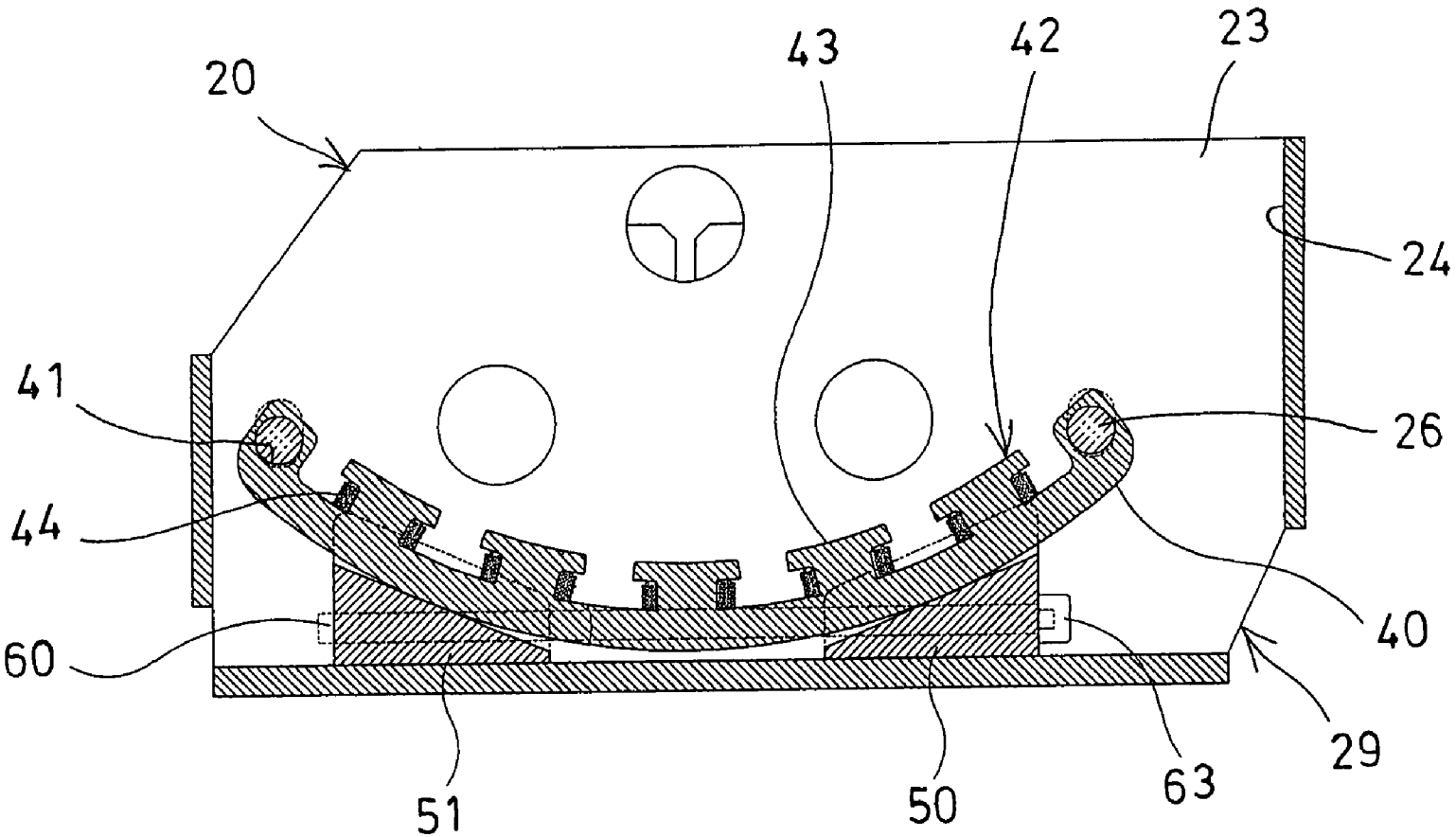
FIG. 3 is a further enlarged partial cross sectional view of the load applying device.

As shown in FIGS. 2-4, the curved arm or lever 40 includes two end screw holes 41 formed therein, for threading with the fasteners 26, which may guide the lever 40 to move up and down along the vertically extending grooves 25 of the casing 20, and includes one or more magnetic devices 42 each having a core 43 extended from the lever 40 and a coil 44 engaged around the core 43, for generating a magnetic force to act onto the rotary member 30, and to apply a resistive force against the rotary member 30.

It is preferable that the lever 40 includes a curvature similar or identical to or corresponding to that of the rotary member 30, and the lever 40 may be guided to move concentrically relative to or toward and away from the rotary member 30, by the sliding engagement of the fasteners 26 along the vertically extending grooves 25 of the casing 20, to allow the magnetic devices 42 to be moved concentrically toward and away from the rotary member 30, in order to evenly apply the load or the resistive or retarding force against the rotary member 30.

Two substantially wedge-shaped blocks 50, 51 are oppositely disposed on two sides of the lever 40, and each includes a recess 52 formed therein for slidably receiving the lever 40, and each includes a screw hole 53 formed therein, for threading with the fasteners 28, which may guide the blocks 50, 51 to move laterally or horizontally along the laterally or horizontally extending slots 27 of the casing 20, and thus to guide the blocks 50, 51 to move toward or away from each other.

The blocks 50, 51 each further includes another screw hole 54, 55 formed therein, and extending along the longitudinal axis of the blocks 50, 51, to allow the screw holes 54, 55 to be aligned with each other, and arranged for threading with another fastener 60. The screw holes 54, 55 include threading or helical direction different from or opposite from each other. The fastener 60 includes two outer threads 61, 62 formed thereon, for threading with the screw holes 54, 55 of the blocks 50, 51, and arranged to move the blocks 50, 51 toward and away from each other when the fastener 60 is rotated relative to the blocks 50, 51.

The fastener 60 includes a head 63 attached to or disposed on one end thereof, for engaging with driving tools (not shown), such as wrenches or screw drivers, which may be used to rotate the fastener 60 relative to the blocks 50, 51, and thus to move the blocks 50, 51 toward and away from each other. The casing 20 includes an opening 29 formed therein (FIGS. 2-5), for allowing the driving tools to engage into the casing 20 and to engage with and to rotate the head 63 of the fastener 60.

Figure 5:
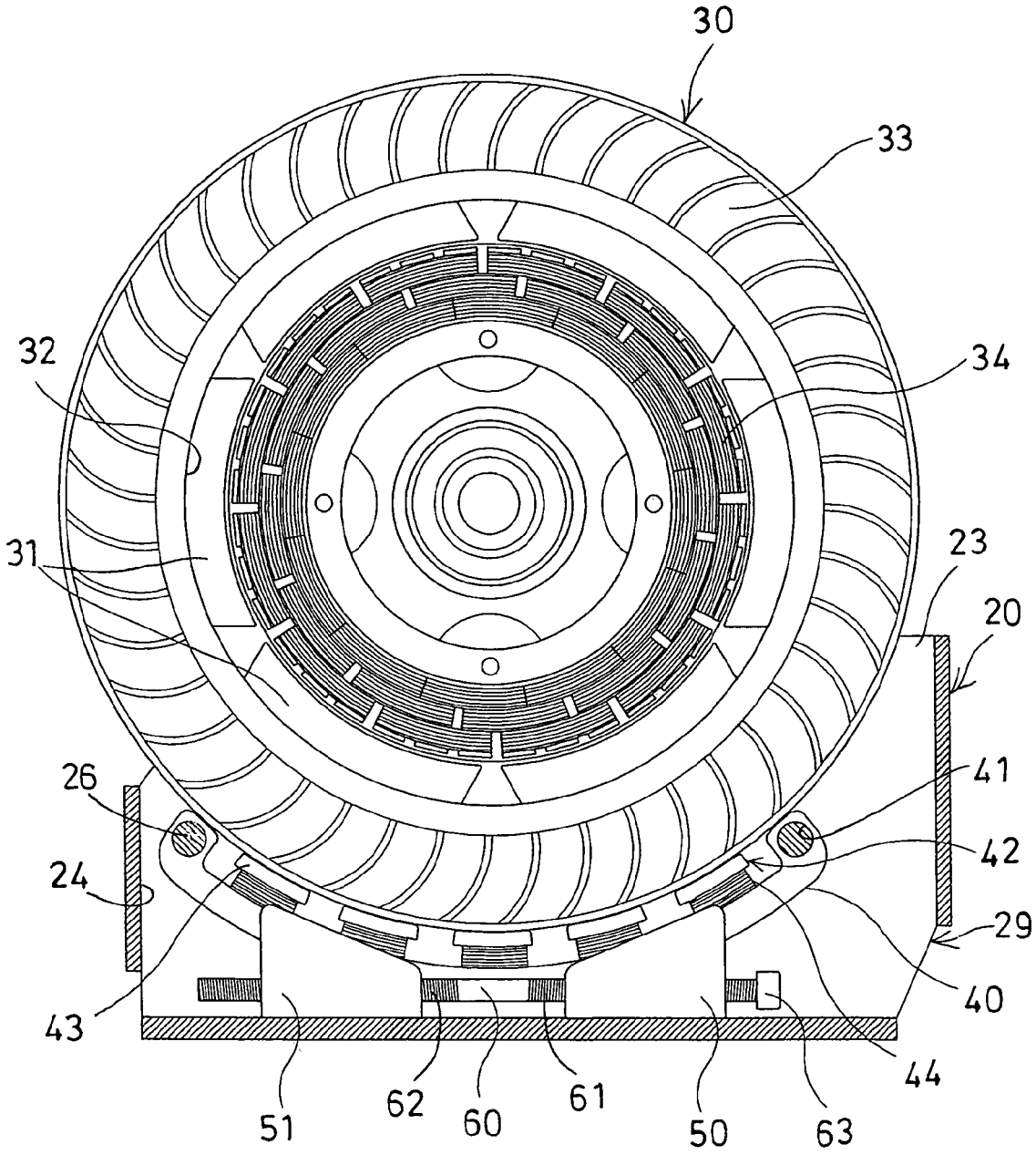
FIG. 5 is an enlarged partial cross sectional view similar to FIG. 2, illustrating the operation of the load applying device.

In operation, as shown in FIGS. 2-3 and 5, when the blocks 50, 51 are guided or forced to move toward and away from each other by the fastener 60, the lever 40 and thus the magnetic devices 42 may be forced to move concentrically toward and away from the rotary member 30, in order to evenly adjust and apply the load or the resistive or retarding force against the rotary member 30. The blocks 50, 51 and the fastener 60 may thus be formed as an adjusting means or device for adjusting the lever 40 and the magnetic devices 42 concentrically relative to the rotary member 30.

The action between the magnetic coil device 34 and the magnetic members 31 of the rotary member 30, and/or the action between the magnetic devices 42 and the rotary member 30 may generate heat while working, and the fan device 33 may be used to generate air streams or air circulations, to dissipate the heat that may be generated by the magnetic coil device 34 and the magnetic devices 42. The fastener 60 may be formed or acted as a moving means or device for moving the blocks 50, 51 toward and away from each other.

The typical load applying devices or magnetic retarding devices fail to provide one or more magnetic devices 42 that may be moved or adjusted concentrically relative to the rotary member 30, or moved or adjusted concentrically toward or away from the rotary member 30.

Accordingly, the load applying device in accordance with the present invention includes a magnetic retarding device adjustable relative to a wheel concentrically, to allow the magnetic retarding device to be moved either toward or away from the wheel concentrically.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A load applying device for an exerciser, the device comprising:

a base including a seat post, a handle, a control device and a driving device;

a magnetic device;

a rotary member rotatably supported on said base with a spindle; and a means for adjusting said magnetic device to apply and adjust a retarding force against said rotary member wherein said driving device is coupled to the rotary member to drive said rotary member, and the adjusting means includes:

a lever having a curvature corresponding to that of said rotary member for supporting said magnetic device;

a casing, disposed on said base, having a first groove and a second groove formed therein to slidably receive first and second fasteners respectively that are threaded to opposing ends of the lever to guide said lever to move along said grooves of said casing such that said lever and said magnetic device can be adjusted concentrically relative to said rotary member;

two blocks disposed within the casing and engaged with said lever; and means for moving the blocks toward and away from each other to adjust said lever relative to said rotary member.

2. The load applying device as claimed in claim 1, wherein said blocks each includes a screw hole formed therein, and said moving means includes a third fastener threaded with said screw holes of said blocks, and arranged to move said blocks toward and away from each other, when said third fastener is rotated relative to said blocks.

3. The load applying device as claimed in claim 2, wherein said third fastener includes a head attached thereto, for engaging with a driving tool.

4. The load applying device as claimed in claim 2, wherein said screw holes of said blocks are arranged opposite to each other, and said third fastener includes two outer threads formed thereon, for threading with said screw holes of said blocks respectively.

5. The load applying device as claimed in claim 1, wherein said blocks each includes a recess formed therein for slidably receiving said lever.

6. The load applying device as claimed in claim 1, wherein said magnetic device includes a core extended from said lever, and a coil engaged around said core, for generating a magnetic force to act onto said rotary member.

* * * * *